United States Patent [19]

Tominaga

[11] Patent Number: 4,993,709

[45] Date of Patent: Feb. 19, 1991

[54] BALL GAME APPARATUS

[75] Inventor: Yasuhiro Tominaga, Tokyo, Japan

[73] Assignee: Pan Pacific Corporation, Tokyo, Japan

[21] Appl. No.: 296,369

[22] Filed: Jan. 10, 1989

Related U.S. Application Data

[63] Continuation-in-part of Ser. No. 252,103, Oct. 3, 1988, abandoned.

[30] Foreign Application Priority Data

Oct. 5, 1987 [JP] Japan ..... 62-250896

[51] Int. Cl.[5] ..... A63B 67/10; A63B 61/00

[52] U.S. Cl. ..... 273/29 A; 273/413; 273/26 A; 273/183 R; 273/26 EA

[58] Field of Search ..... 273/26 E, 26 EA, 29 R, 273/29 A, 29 B, 184 R, 184 A, 183 R, 185 A, 185 B, 185 C, 413, 55 B

[56] References Cited

U.S. PATENT DOCUMENTS

| | | | |
|---|---|---|---|
| 1,959,573 | 5/1934 | Dieball | 273/26 A |
| 2,839,300 | 6/1958 | Blaha et al. | 273/26 E |
| 3,105,682 | 10/1963 | Ahrens | 273/413 |
| 3,706,451 | 12/1972 | Dixon | 273/29 |
| 3,951,406 | 4/1976 | Rock | 273/29 R |
| 3,989,246 | 11/1976 | Brown et al. | 273/29 A |
| 4,029,315 | 6/1977 | Bon | 273/183 R |
| 4,070,018 | 1/1978 | Hodges | 273/29 A |
| 4,082,271 | 4/1978 | Martin | 273/29 A |
| 4,375,888 | 3/1983 | Wilcox | 273/184 R |
| 4,456,251 | 6/1984 | Balaz | 273/29 A |
| 4,521,016 | 6/1985 | Tominaga | 273/29 A |
| 4,632,394 | 12/1986 | Ryan | 273/26 E |

FOREIGN PATENT DOCUMENTS

| | | | |
|---|---|---|---|
| 269781 | 12/1964 | Australia | 273/185 C |
| 0241211 | 10/1987 | European Pat. Off. | 273/29 A |
| 3017335 | 5/1980 | Fed. Rep. of Germany . | |
| 3322901 | 6/1983 | Fed. Rep. of Germany . | |
| 3713850 | 11/1988 | Fed. Rep. of Germany | 273/29 A |
| 2562431 | 10/1985 | France | 273/29 A |
| 8402475 | 7/1984 | World Int. Prop. O. | 273/29 A |
| 8500019 | 1/1985 | World Int. Prop. O. | 273/29 A |

*Primary Examiner*—Edward M. Coven
*Assistant Examiner*—Jessica J. Harrison
*Attorney, Agent, or Firm*—Fleit, Jacobson, Cohn, Price, Holman & Stern

[57] ABSTRACT

A ball game apparatus includes a loosely put-up net, an elastic cord one end of which is connected to a fixed frame of the net and the other end of which is connected to a ball, and a target, located behind the net, for outputting ball speed and hit signals of the ball flying toward the net.

22 Claims, 12 Drawing Sheets

BALL GAME APPARATUS

This application is a continuation-in-part of application Ser. No. 252,103, filed Oct. 3, 1988, now abandoned.

BACKGROUND OF THE INVENTION

1. Field of the Invention

The present invention relates to a sport apparatus and, more particularly, to a ball game apparatus with which a player can enjoy training of tennis and other ball games together with factors of an electronic game.

2. Description of the Related Art

In order to train for a tennis match outside the court, a player hits a ball against a net put up with an optimal tension and continuously hits the ball returned from the net due to an elastic force of the net. Alternatively, as described in U.S. Pat. No. 4,521,016, a suspended ball tied to an elastic cord is hit against a loosely put-up net and is returned by an elastic force of the elastic cord. In a ball game apparatus described in U.S. Pat. No. 4,521,016, two vertical columns spaced apart from each other by about a distance corresponding to the width of the net stand in front of the loosely put-up net, and a ball is tied to an elastic cord suspended from the center of a horizontal frame bridged between the vertical columns to allow training for volleys. A ball is tied between elastic cords tied between the roots of the columns to train for ground strokes. However, with the above structure, the columns interfere the player, and ball positions for ground strokes are not constant, resulting in inconvenience. In particular, it is inconvenient for a handicapped player in a wheelchair to train for a tennis match because of the presence of columns.

Balls used in ball games have different sizes. The smallest ball is a golf ball and the largest ball is a soccer ball. When the tension of the net is constant, the speed of the ball returned from the net is changed in accordance with the size and weight of the ball. When a given ball is hit against the net, the speed of the ball returned from the net is changed in accordance with a change in tension of the net. Therefore, in order to optimally train for a ball game, the tension of the net must be appropriately adjusted. In a conventional ball game apparatus, the tension of the net is predetermined or a large number of strings tied at four corners and sides of the net must be tightened or loosened. Strong demand has arisen for allowing simple adjustment of a tension of a net in accordance with the type of ball and a desired speed of the ball returned from the net.

In another conventional ball game apparatus, a target is attached to the center of a tennis training net, and the player hits a ball toward the target. In this case, the player can know only whether the ball is hit against the target. For example, the ball speed which is the most important factor particularly in a tennis game cannot be measured.

Various conventional ball game apparatuses provide only monotonous training contents and are not interesting. Therefore, demand has arisen for a ball game apparatus which allows the player to enjoy training for a long period of time without loss of interest.

SUMMARY OF THE INVENTION

The present invention has been made to solve the drawbacks of conventional ball game apparatuses, and has as its object to provide a ball game apparatus which allows various types of training (e.g., continuous best pitches and slugs) in a relatively narrow space and employs game-like factors to improve efficiency of training.

In order to achieve the above object of the present invention, there is provided a ball game apparatus wherein one side, e.g., the upper end, of a vertically suspended net is fixed to a fixed frame, the lower end of the net is attached to a movable frame, means for adjustably engaging the movable frame to the fixed frame to allow adjustment of a tension of the net, and at the same time, there is provided a target means having a field of view of a predetermined size and a function for detecting a ball speed within the field of view to display the number of hits and a ball speed.

DETAILED DESCRIPTION OF THE PREFERRED EMBODIMENTS

Figure 1:
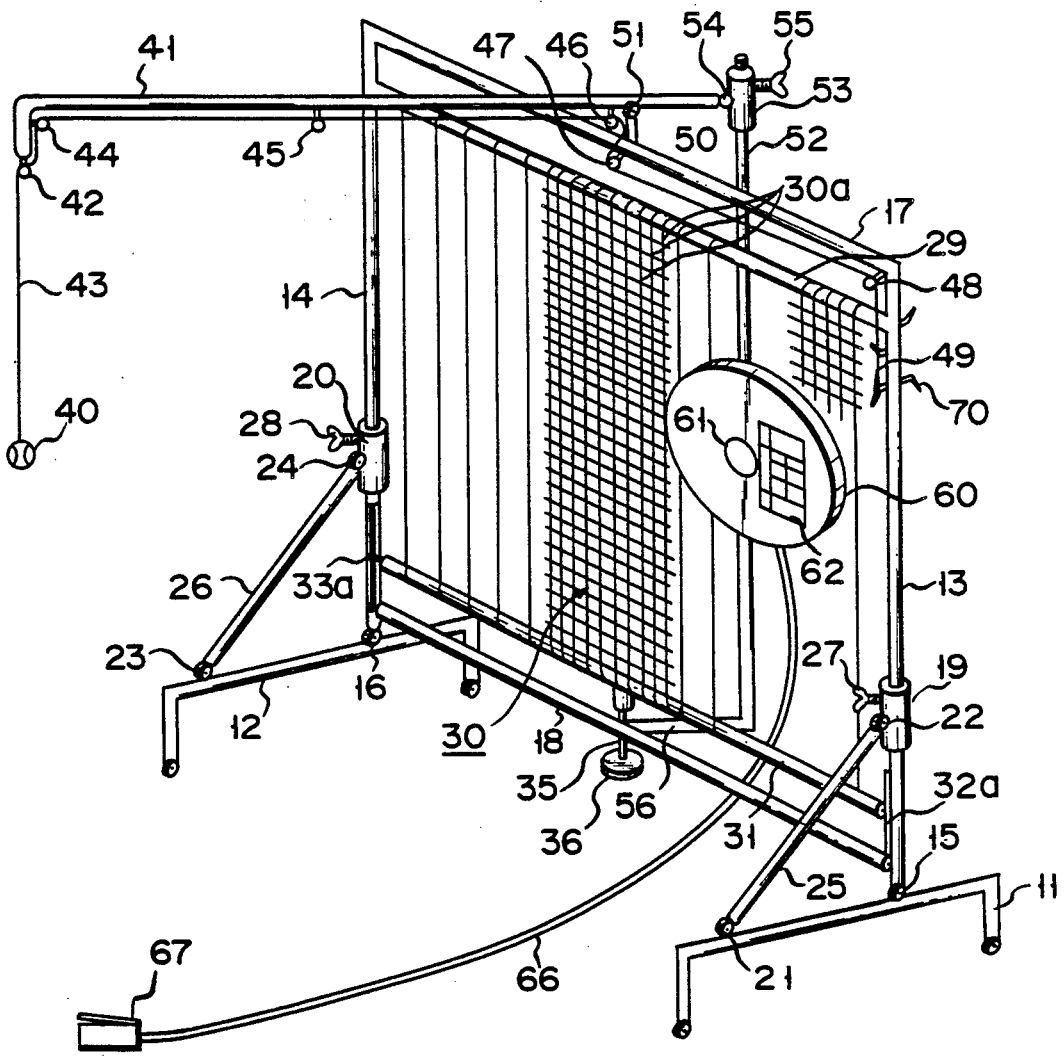
FIG. 1 is a perspective view of a ball game apparatus according to an embodiment of the present invention.

Referring to FIG. 1, two vertical frames 13 and 14 are mounted on inverted U-shaped leg frames 11 and 12 through pivot joints 15 and 16, respectively. Two horizontal frames 17 and 18 are connected to upper and lower end portions of vertical frames 13 and 14, respectively. Two slide pipes 19 and 20 are coupled to vertical frames 13 and 14, respectively. Slide pipes 19 and 20 are connected to leg frames 11 and 12 by support pipes 25 and 26 through pivot joints 21 and 22 and pivot joints 23 and 24. When slide pipes 19 and 20 are vertically slid on vertical frames 13 and 14, vertical frames 13 and 14 are laid back and forth about pivot joints 15 and 16. Set screws 27 and 28 are mounted on slide pipes 19 and 20, respectively, so that vertical frames 13 and 14 can be fixed at a desired angle.

Another horizontal frame 29 parallel to upper horizontal frame 17 is fixed as a net suspending frame between vertical frames 13 and 14. The upper ends of vertical strings 30*a* of net 30 are fixed to horizontal frame 29. The lower ends of vertical strings 30*a* of net 30 are fixed to horizontal movable frame 31.

Figure 2:
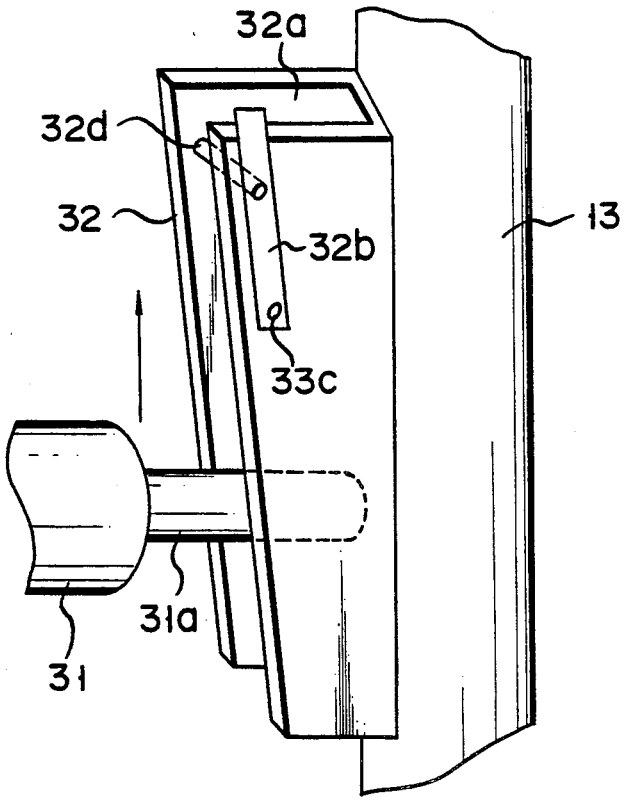
FIG. 2 is an enlarged view for explaining engagement between movable and fixed frames in FIG. 1.

Both ends of movable frame 31 are engaged with guide grooves 32*a* and 33*a* formed in the lower end portions of vertical frames 13 and 14, respectively. When the net 30 is loosely put up so as to prevent a rebound of the ball from the net, movable frame 31 can be vertically moved. As shown in FIG. 2, engaging member 31*a* extends from each end of movable frame 31 and is engaged in guide groove 32*a* of guide 32 at the lower end portion of vertical frame 13. Therefore, movable frame 31 can be vertically moved. Guide groove 32*a* is tapered deeper toward its upper end, and pin 32*d* extends in guide groove 32*a* at the upper end of leaf spring 32*b* fixed by screw 33*c*.

Figure 3:
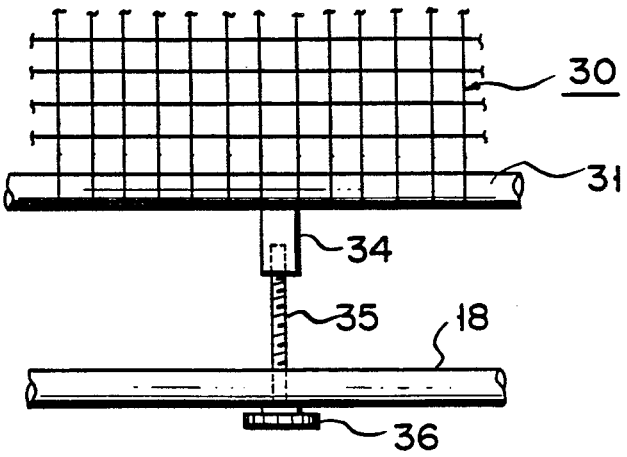
FIG. 3 is a view for explaining adjustment for putting up a net shown in FIG. 1.

As shown in the enlarged view of FIG. 3, extended portion 34 extends downward or upward at substantially the center of movable frame 31. Bolt 35 is threadably engaged in extended portion 34. Bolt 35 extends through a hole formed in net fixing horizontal frame 18 horizontally fixed between the lower end portions of vertical frames 13 and 14. Handle 36 is fixed at the lower end of bolt 35. In order to tightly put up the net 30 so as to allow a rebound of the ball from the net 30, handle 36 is turned in one direction, bolt 35 is inserted in extended portion 34 and movable frame 31 is pulled in the direction toward horizontal frame 18. Therefore, the entire surface of net 30 is strongly pulled downward. When handle 36 is turned in the opposite direction, net 30 is loosened.

For example, training tennis ball 40 is tied to the distal end of elastic cord 43 suspended from pulley 42 at the distal end of ball support frame 41 extended forward from the upper portion of net 30, as shown in FIG. 1. Elastic cord 43 is guided to pulleys 47 and 48 of horizontal frame 17 through wheels 44, 45, and 46 arranged midway along ball support frame 41 and is wound around rubber reel 49 on vertical frame 13. Therefore, the length of elastic cord 43 from pulley 42 can be adjusted by the number of turns of elastic cord 43 on rubber reel 49.

The intermediate portion of ball support frame 41 is supported on pivot joint 51 on support 50 arranged on horizontal frame 17. The proximal end of ball support frame 41 is coupled through pivot joint 54 to slide pipe 53 arranged on third vertical frame 52. When slide pipe 53 is slid along vertical frame 52, ball support frame 41 can be vertically inclined. Slide pipe 53 is fixed at an arbitrary position on vertical frame 52 by set screw 55. For example, when slide pipe 53 is moved downward from the illustrated position, the distal end of ball support frame 41 is moved upward, and the position of tennis ball 40 is highered. Therefore, a player can train for smashes.

Figure 4:
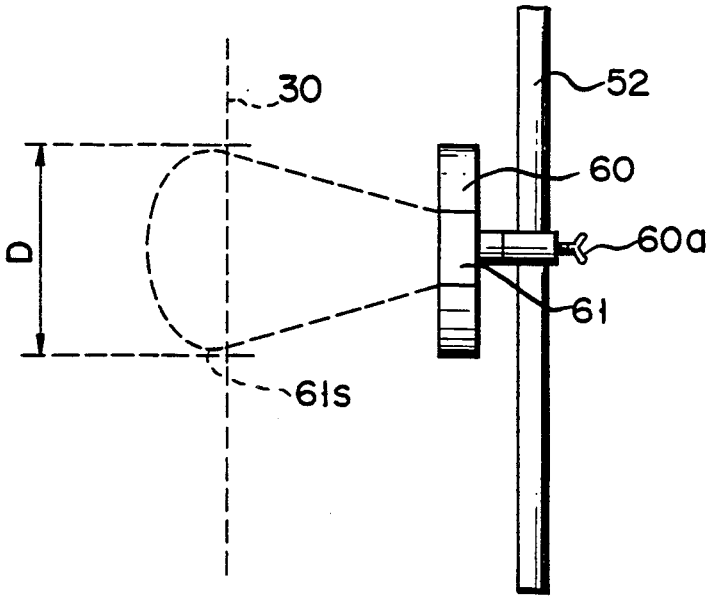
FIG. 4 is a view for explaining a detection range of a target.

The lower end of vertical frame 52 is fixed to horizontal support pipe 56 extending from substantially the center of horizontal frame 18 behind net 30. Target 60 is fixed by screw 60*a* at a position on vertical frame 52 corresponding to substantially the center of net 30, as shown in FIG. 4. Target 60 has a substantially circular shape. A window for speed gun 61 directed toward net 30 and liquid crystal display unit 62 for displaying output information from speed gun 61 are located at the center of target 60.

Figure 5:
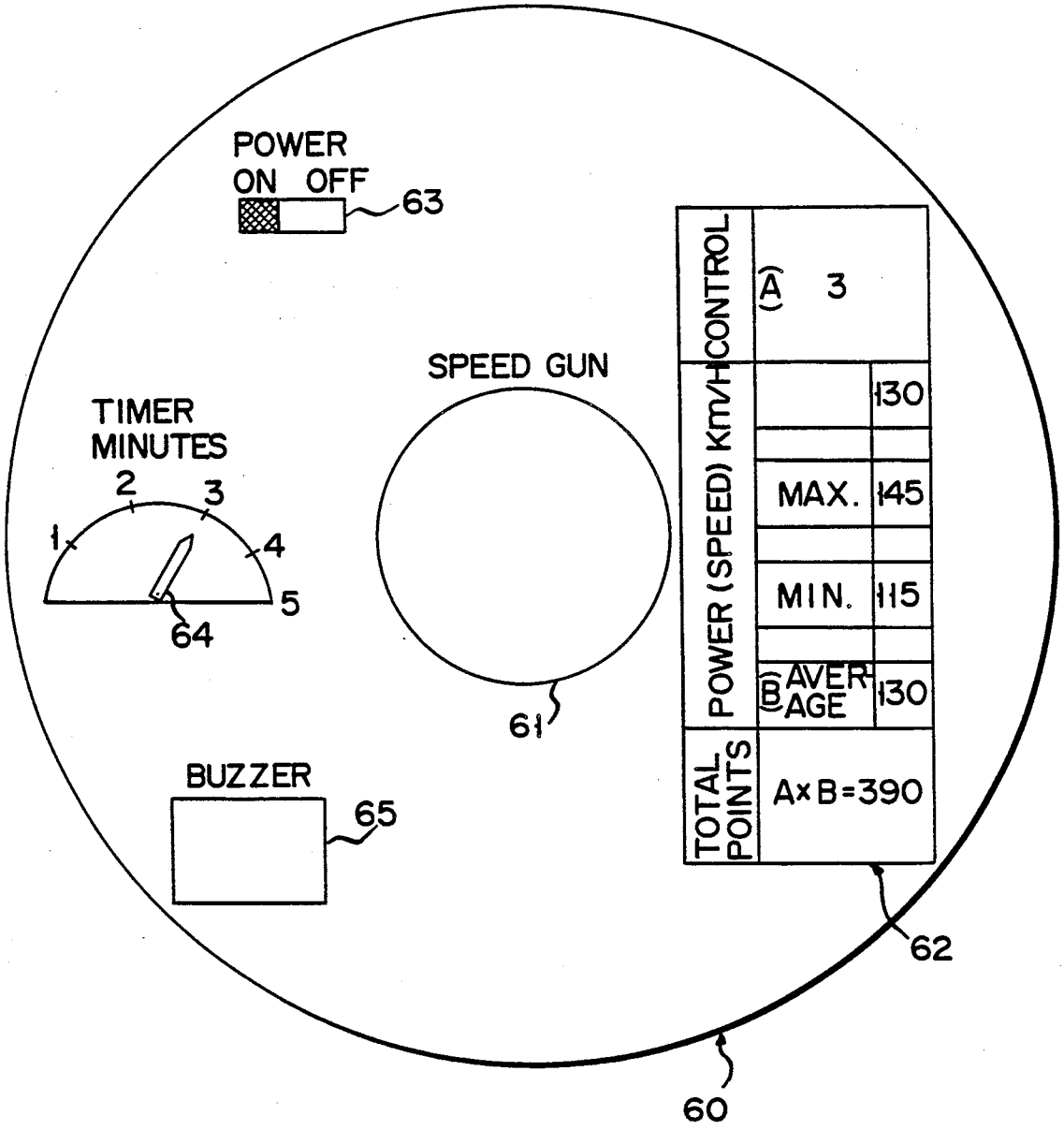
FIG. 5 is an enlarged front view of the target in FIG. 1.

Target 60 includes power switch 63, timer 64, and buzzer 65 in addition to speed gun 61 and liquid crystal display unit 62, as shown in FIG. 5. Cable 66 is connected to target 60, guided in front of net 30, and connected to remote foot switch 67. When speed gun 61 is spaced apart backward from net 30 by a predetermined distance, as shown in FIG. 4, it detects a speed of a ball hitting the center of net 30. At the same time, speed gun 61 has a sensing range such that a speed of the ball hit on net 30 is only measured by utilizing a Doppler effect. For example, as shown in FIG. 4, target 61 has circular sensing range 61*s* having substantially the same diameter as that of target 60.

An operation of the ball game apparatus shown in FIGS. 1 to 5 will be described below. This apparatus requires only a small space, i.e., a width of 2 m and a depth of 2.5 m. For example, this apparatus can be set in a garage to allow a user to enjoy training.

Before the player stands in a predetermined position in front of net 30, he or she turns on power switch 63 of target 60 behind net 30. Timer 64 is set to be, e.g., 3 minutes. The player stands near tennis ball 40 in front of net 30 and depresses remote foot switch 67.

In this state, when the player hits tennis ball 40 toward target 60 and ball 40 enters sensing range 61*s* of speed gun 61 immediately prior to hitting of the ball against net 30, speed gun 61 detects a hit and measures a speed of the ball. As a result, the number of hits "1", and the ball speed of, for example, 115 km/H are displayed on liquid crystal display unit 62. When ball 40 hits against net 30, ball 40 is bounced from net 30 by an elastic force of elastic cord 43 or net 30. The player hits ball 40 toward net 30 again. When the ball 40 enters sensing range 61*s*, speed gun 61 detects a hit and measures a speed of the ball. The number of hits is displayed as "2" on display unit 62. If the speed is, e.g., 145 km/H, this speed is also displayed on display unit 62. Similarly, the third hitting cycle is detected as a hit and a ball speed is measured as 130 km/H. This state is illustrated in FIG. 5. The number of hits, the current ball speed, the maximum speed, the minimum speed, and the average speed are respectively displayed as "3", 130 km/H, 145 km/H, 115 km/H, and 130 km/H, respectively. In this manner, training results until the latest hit are displayed in accordance with the acquired data.

When one minute and two minutes of the three minutes set in timer 64 have elapsed and when a hit occurs, the buzzer may be operated. Remote foot switch 67 is also used to interrupt the operation of timer 64. When three minutes are set in timer 64, considerably hard training is required to obtain a large number of hits within such a short set time of three minutes. Therefore, a training quantity is naturally increased. When the three minutes set in timer 64 have elapsed, buzzer 65 is operated to signal the end of training. Total number A of hits on target 60, e.g., 30 hits, is displayed. At the same time, the maximum speed, the minimum speed, and average speed B are displayed as 145 km/H, 115 km/H, and 130 km/H, respectively. A product of A and B is calculated, and the calculation result is displayed as total points as 3,900. Training with this apparatus is not limited to training for tennis but the player can enjoy training with factors of an electronic game, thereby providing a healthy entertainment.

The tension of net 30 may be increased by turning handle 36 to increase a return speed of ball 40. Under this condition, the number of hits during the operation of timer 64 may be contested. To the contrary, net 30 may be loosely put up. In this condition, the total points as the product of the number of hits and the ball speed may be contested. Various kinds of training can be performed by changing various conditions such as the tension of net 30, the length of elastic cord 43, the inclination of ball support frame 41, and the inclination of net 30.

Figure 6:
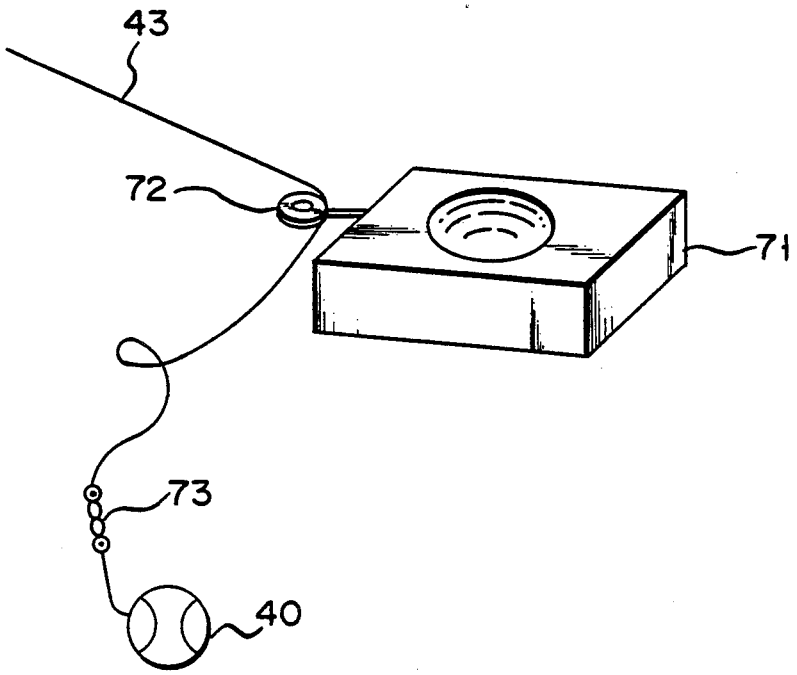
FIG. 6 is a view showing another method of supporting a ground stroke tennis ball.

In the above description, ball 40 is suspended from the distal end of ball support frame 41. However, an elastic cord may be wound around another reel 70 on vertical frame 13, guided below vertical frame 13 through a pulley (not shown), and engaged with pulley 72 of counterweight 71 (FIG. 6) located in front of net 30. In this case, ball 40 is put on the floor. Elastic cord 43 is preferably coupled to ball 40 through swivel joint 73 because elastic cord 43 is strongly twisted when ball 40 rolls on the floor. An elastic cord or a nylon string may be connected between ball 40 and swivel joint 73.

In the above description, the tennis ball 40 is tied to an elastic cord 43 and is hit against a loosely put-up net 30. However, a tennis ball which is not tied to an elastic cord may be hit against a net with an optimal tension.

The above description exemplifies a tennis training apparatus. When a large ball such as a soccer ball is used, net 30 can be easily loosened by handle 36, resulting in convenience. In the case of baseball training, training for pitching, fielding, and batting without an elastic cord can be performed. In the above description, the fixed target 30 is used. However, a target may be movable in the upper, lower, left, and right directions. In this case, one of the players moves the target and the other player hits a ball toward the moving target. The players can enjoy training more.

A conventional electronic game does not accompany physical training, and demand has arisen for a more healthy game. Factors of an electronic game are employed in a physical training game. Training for baseball, golf, soccer, volleyball or the like can be performed. In addition, physical training can be achieved while the player enjoys an electronic game.

Figure 7:
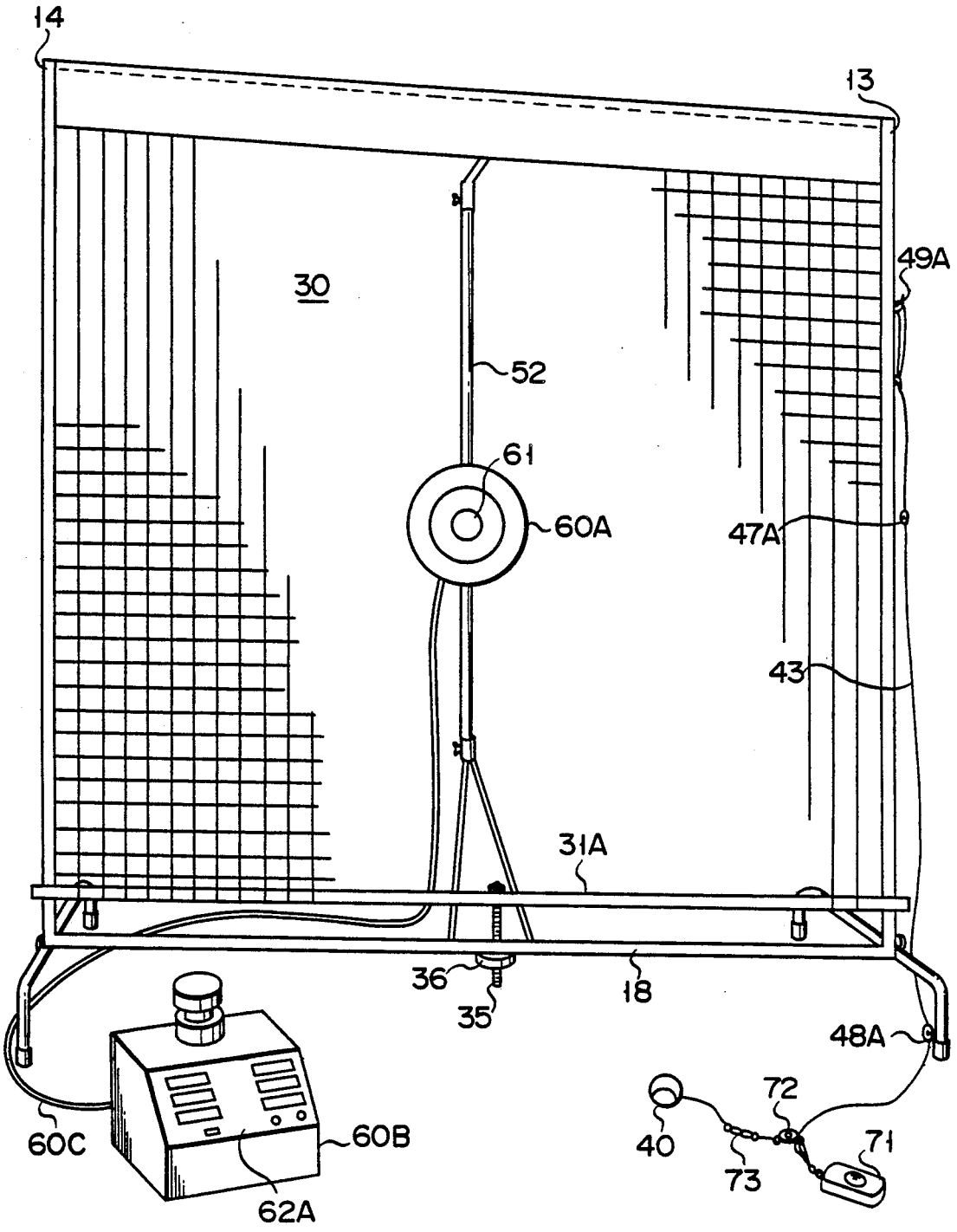
FIG. 7 is a perspective view of another embodiment of the present invention.

FIG. 7 shows another embodiment of the present invention in which those portions corresponding to those of FIG. 1 are denoted by the same or similar references. In this embodiment, target 60A is fixed on vertical frame 52 provided behind net 30. Target 60A has speed gun 61 at the center thereof to have a sensing range having the substantially the same diameter as that of target 60, as in the case of the first embodiment. Speed gun 61 is connected to target control unit 60B through cable 60C. Target control unit 60B is put in front of net 30 and is provided with display section 62A and function switches to be described later. Target control unit 60B further includes at the top thereof play start switch 67A which corresponds to foot switch 67 of FIG. 1 embodiment.

Bolt 35 is fixed on the center of horizontal frame 31 at one end thereof. The free end of bolt 35 is inserted in a through hole provided in the corresponding portion of lower horizontal frame 18. Handle acting as a nut is engaged from the lower end of bolt 35. Therefore, when handle is rotated in one direction on bolt 35, handle 36 first contacts at the lower side of horizontal frame 18 and pulls horizontal frame 31 toward frame 18, whereby tension is applied to net 30. The tension of net 30 is easily adjusted by rotating handle 36.

Figure 9:
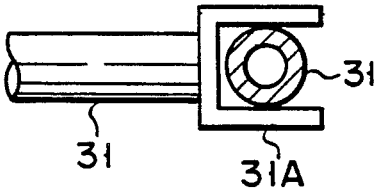
FIG. 9 shows a sectional view of an end portion of a movable frame engaging a vertical frame of FIG. 7.

Rubber cord 43 is wound about rubber reel 49A provided on vertical frame 13 and guided through pulleys 47A and 48A to pulley 72 provided to counter-weight 71. One end of rubber cord 43 is connected to swivel joint 73 the other end thereof is connected to tennis ball through nylon cord. One end of horizontal frame 31 is engaged with vertical frame 13 as shown in FIG. 9 wherein an engaging member 31A is fixed at the tip of frame 31 so that engaging member 31A engages with vertical frame 31. The other end of horizontal frame 18 is engaged with vertical frame 14 in the similar manner.

The remaining parts of the embodiment of FIG. 7 are similar to those of embodiment of FIG. 1, and a further explanation is omitted here.

Figure 8:
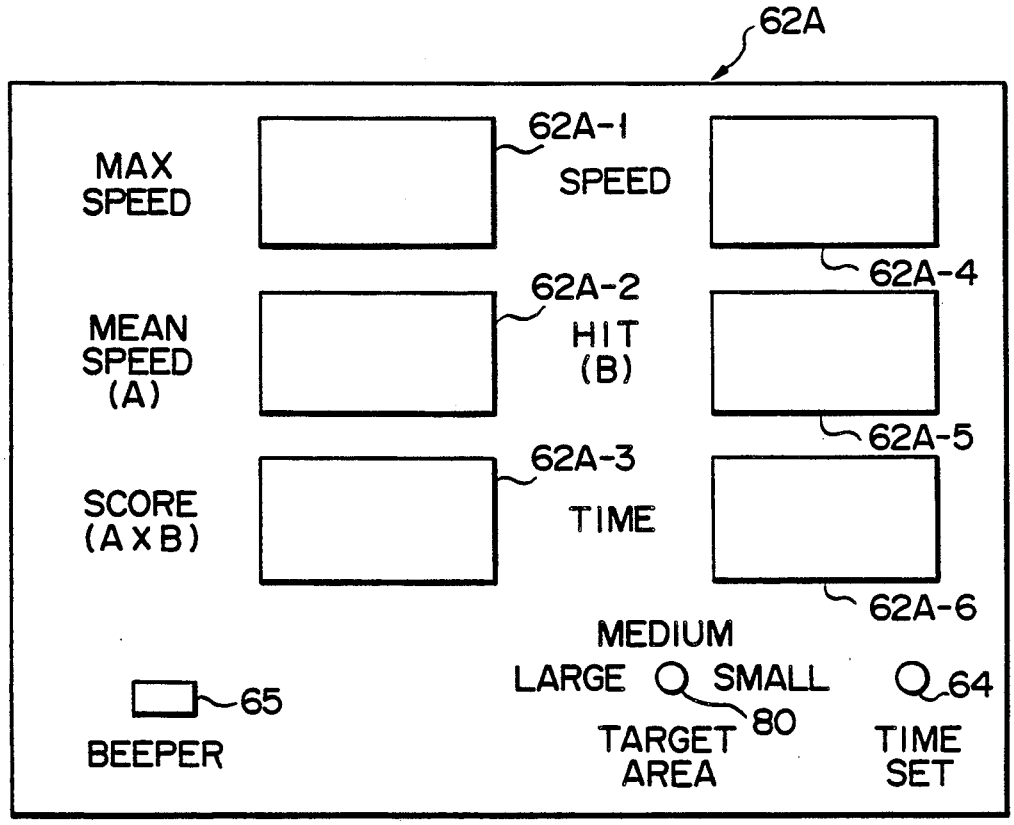
FIG. 8 shows an enlarged view of a control section of the target shown in FIG. 7.

Now, display section 62A of control unit 60B will be described in detail by referring to FIG. 8. In the figure, six display windows 62A-1, . . . 62A-6 are provided on the display pannel in which target area setting switch 80, time setting switch 64 and beeper 65 are further provided. Display window 62A-1 is for the maximum speed, 62A-2 mean speed (A), 62A-3 score (A×B), 62A-4 speed, 62A-5 number of hits and 62A-6 set time. The operation of target 60A and control unit 60B will be described later by referring to FIGS. 14 and 15.

Figure 10:
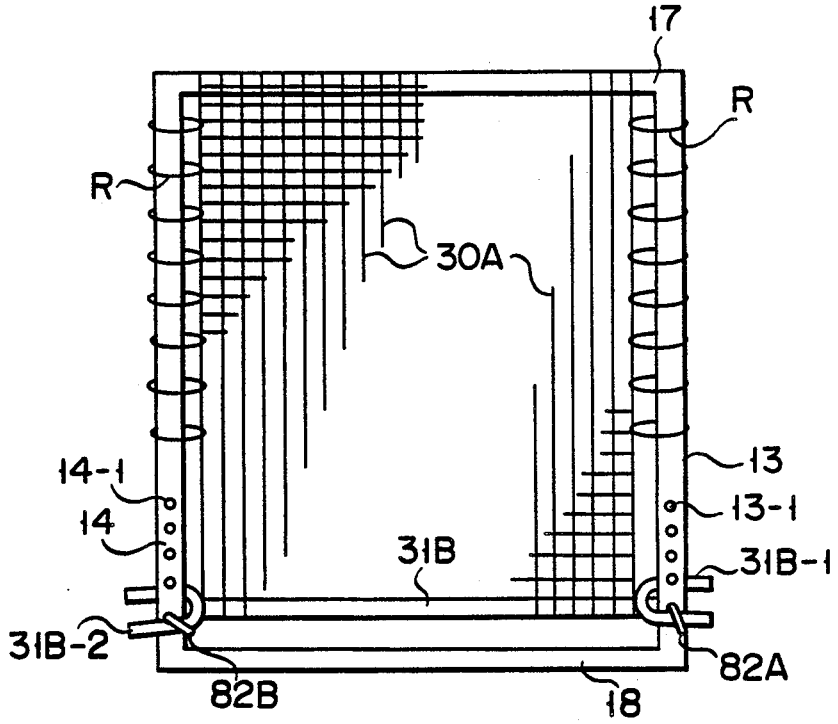
FIG. 10 shows a further embodiment apparatus according to the present invention.

FIG. 10 shows a net assembly of a further embodiment of the present invention in which right and left frames 13 and 14 and upper and lower frames 17 and 18 are provided for supporting both vertical sides and upper side of net 30A. Right and left sides of net 30A are engaged to corresponding side frames 13 and 14 via a plurality of plastic rings R so as to loosely support sides of net 30A. The lower side of net 30A is supported by an adjusting horizontal frame 31B. Frame 31B has U-shaped end members 31B-1 and 31B-2 to be engaged with both vertical side frames 13 and 14 as shown in the figure. Two side frames 13 and 14 have a plurality of stopping holes 13-1, 14-1 formed at the lower portion of respective side frames 13 and 14 to stop horizontal frame 31B at a desired hole position by means of stopping rods 82A and 82B, whereby a desired tension can be applied to net 30A. when a desired tension is to be applied to net 30A, one of end members, end member 31B-2 is first pushed down to reach the same at the desired hole position and stopping rod 82B is inserted at the hole to stop one end of frame 31B. Then, the other end of frame 31B is lowered in the same way. At this time when the tension of net 30A is very strong to push down member 31B-1 by hand, it may be lowered by using a foot.

Figure 11:
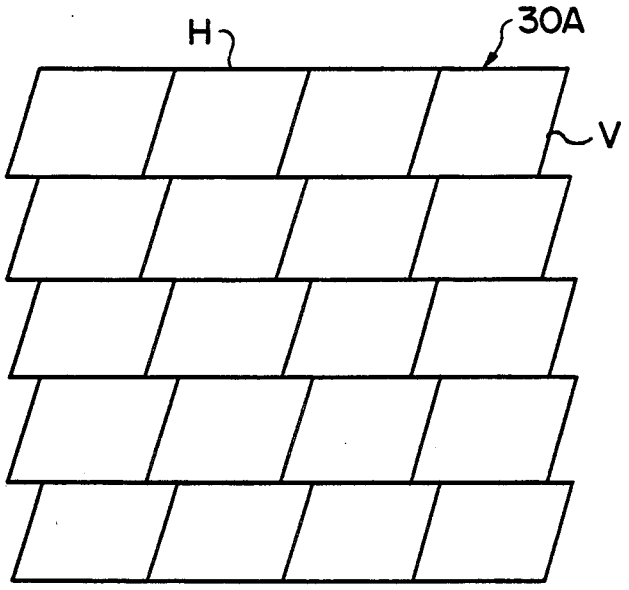
FIGS. 11 and 12 show a net structure used in the embodiment of FIG. 10.
Figure 12:
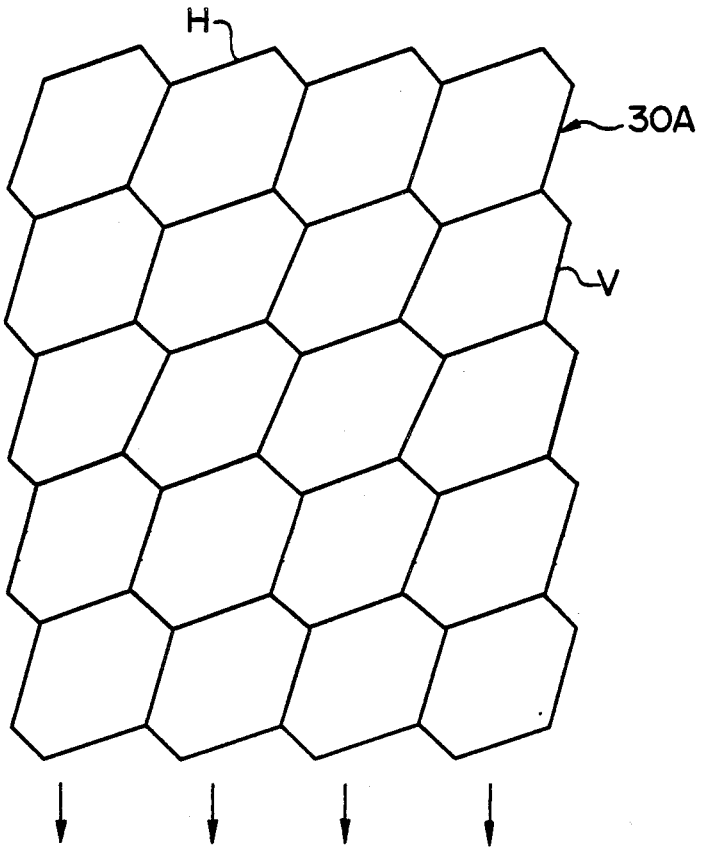

Now the structure of net used in the FIG. 10 embodiment is described. When no tension is applied to net 30A, it has an original shape as shown in FIG. 11 in which horizontal threads H are extended substantially in a straight line. When a desired tension is applied to net 30A in the manner described above, the vertical threads V are respectively pulled down as shown in arrows in FIG. 12 in which even if the vertical threads V are pulled down, horizontal threads H are held in the horizontal direction. As a result, horizontal threads H will be deformed to a shaped as shown in FIG. 12, whereby tension will be applied to all the threads H and V.

Figure 13:
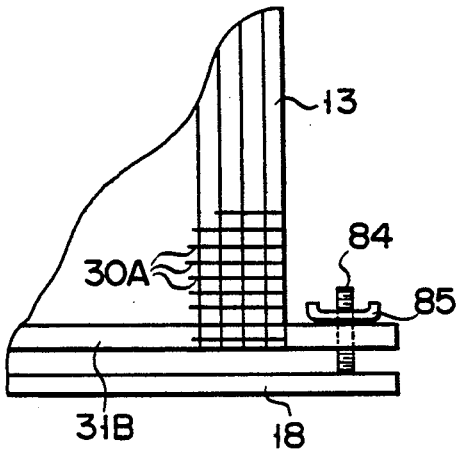
FIG. 13 shows a modified structure for applying tension to the net.

FIG. 13 shows a modification structure for pulling down horizontal frame 31B towards the supporting frame 18. Bolt 84 is fixed to supporting frame 18 at one end thereof. Bolt 84 is inserted in a through hole provided in frame 31B to be projected at the upper portion of frame 31B. On bolt 84 projected in the upper portion of frame 84 is engaged with a nut 85. In the figure, when nut 85 is rotated in a direction the frame 31B is lowered to reach to frame 18, whereby net 30A can be applied with strong tension.

Figure 14:
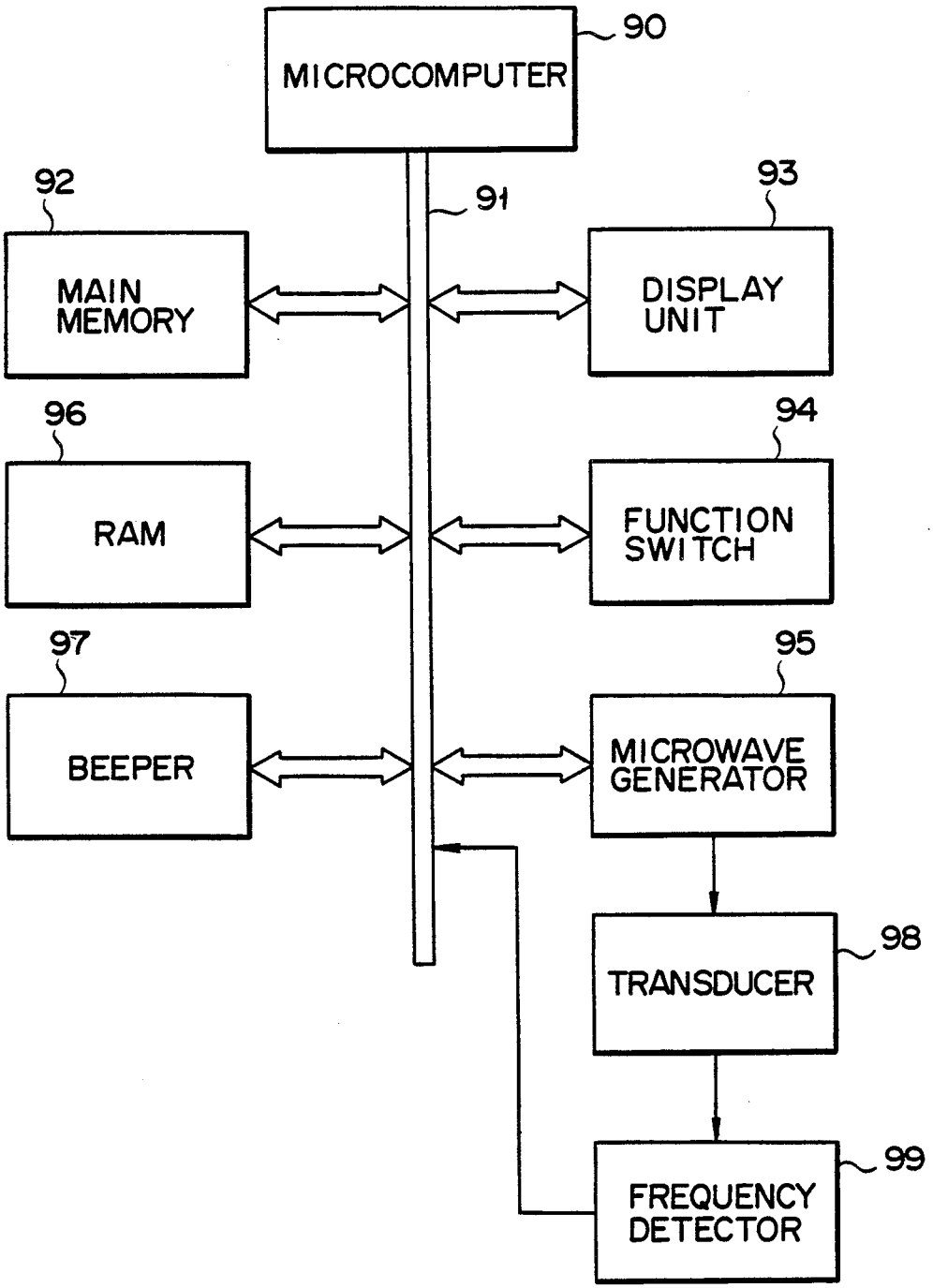
FIG. 14 shows an electronic control section of the target used in the embodiments of FIG. 1 and FIG. 7.

FIG. 14 shows a circuit structure of the target and control unit of the described embodiments of FIG. 1 and FIG. 7. In the figure, micro-computer 90 is coupled to a system bus 91 to which main memory is connected to store a predetermined program to control all the units used in the embodiments. To system bus 91 are connected display unit 93 corresponding to display windows 62A-1 to 62A-6 and function switches corresponding to target area setting switch 80, time setter switch 64 and start switch 67. Microwave generator 95, RAM 96 and beeper 97 are also connected to system bus 91. Target area setting switch 80 has three positions for adjusting the sensitivity of target gun 61 as shown in FIG. 8. For example, the diameter D of the serving area can be varied in three ranges, i.e., 50 cm, 40 cm and 30 cm. An output of microwave generator 95 has an oscillation frequency of, for example, 10.252 MHz which is supplied to transducer 98 to transmit a microwave and to receive the microwave reflected from a ball hit at speed gun 61. An output of transducer 98 is supplied to frequency detector 99.

Figure 15:
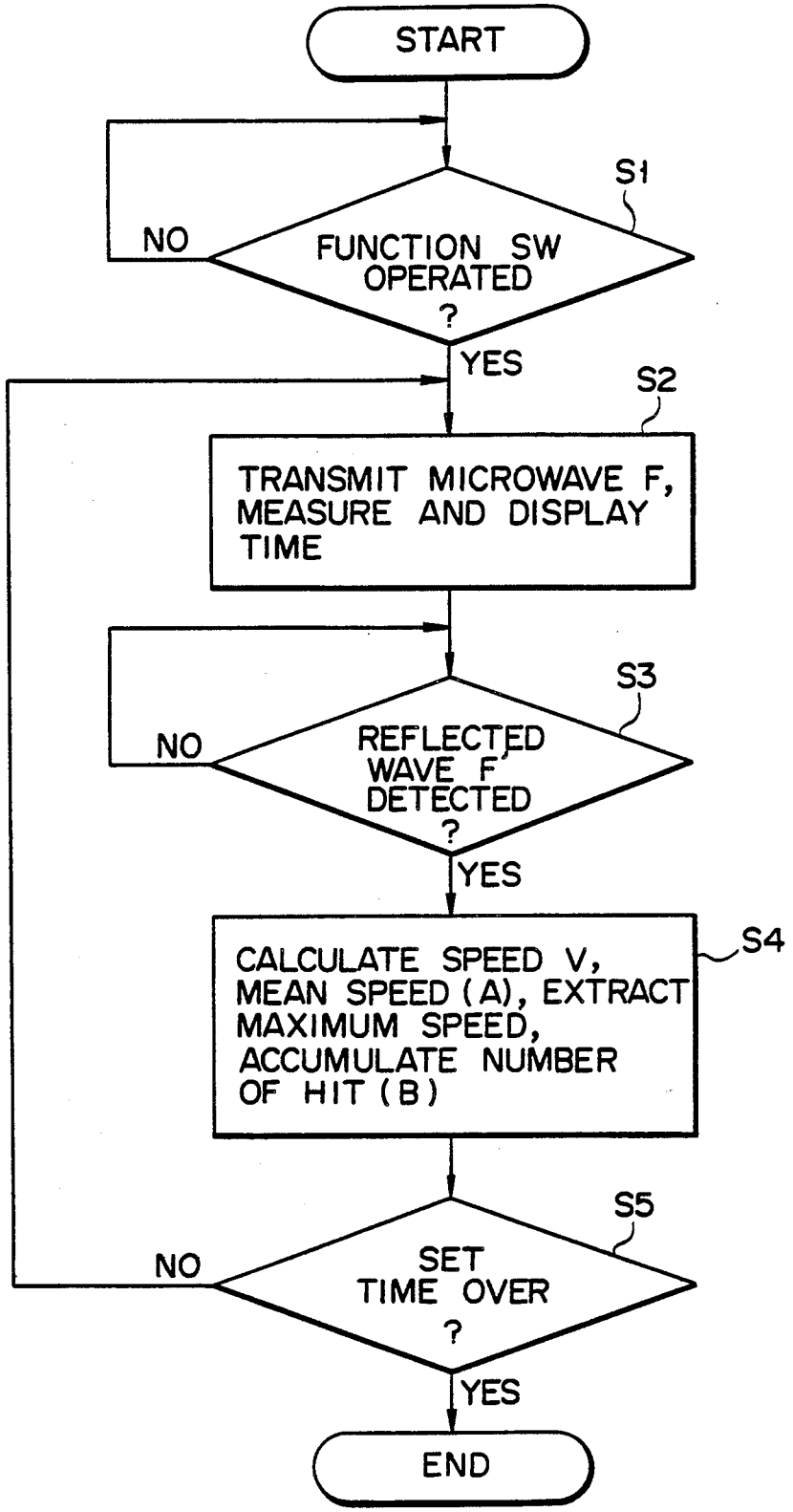
FIG. 15 is a flow chart for explaining an operation of a microcomputer used in the embodiments of FIGS. 1, 7, and 10.

Now an operation of the embodiment of FIG. 7 will be described in detail by referring to the flow chart of FIG. 15. The operation of the embodiment of FIG. 1 is similar to that of FIG. 7, and a detailed description will be omitted here.

In the Figure, at the first step S1, a judge is made whether any of function switch is operated. If YES in the step S1, beeper 97 is driven for three seconds and microwave generator 95 is driven to generate 10.252 MHz and in the same time, a timer is driven to measure and display a time on the display window 62A-6, in second step S2.

Then, the process is shifted to the next step S3 at which whether a reflected microwave is detected at frequency detector 99. Assuming that the transmitted frequency of the microwave is F and the reflected and detected frequency thereof is F'. When ball 40 is detected, beeper 97 is driven for one second and the velocity v of the ball detected in the detection area in front of speed gun 61 can be calculated using the following equation:

$v = F' - F / C$, where C denotes a constant, in the step S4. In the step S4, mean speed (A), maximum speed, accumulated number of hits (B) are calculated. In operation, beeper 97 is driven every one minutes for two seconds.

In the next step S5, check is made whether the set time is over. If NO in step S5, the steps S2 to S4 are repeated until the YES is obtained in the step S5. When the game is over, beeper 97 is driven for three seconds. Beeper 97 may be driven to generate different pitch sound.

Figure 16:
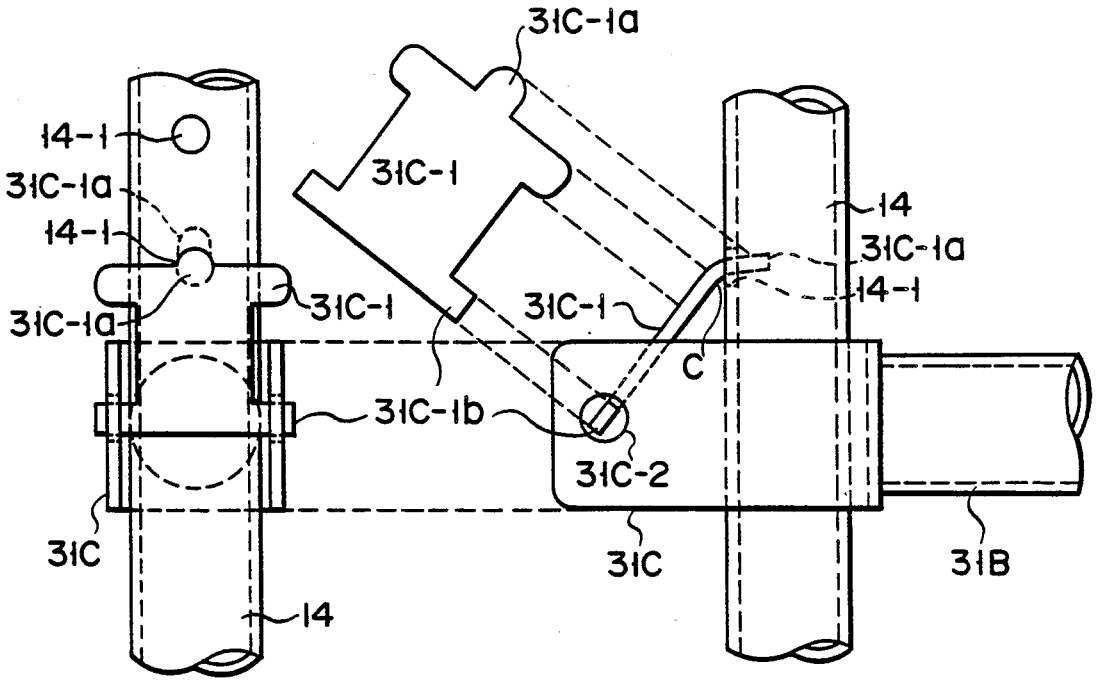
FIGS. 16 and 17 show a modification of the embodiment shown in FIG. 10.
Figure 17:
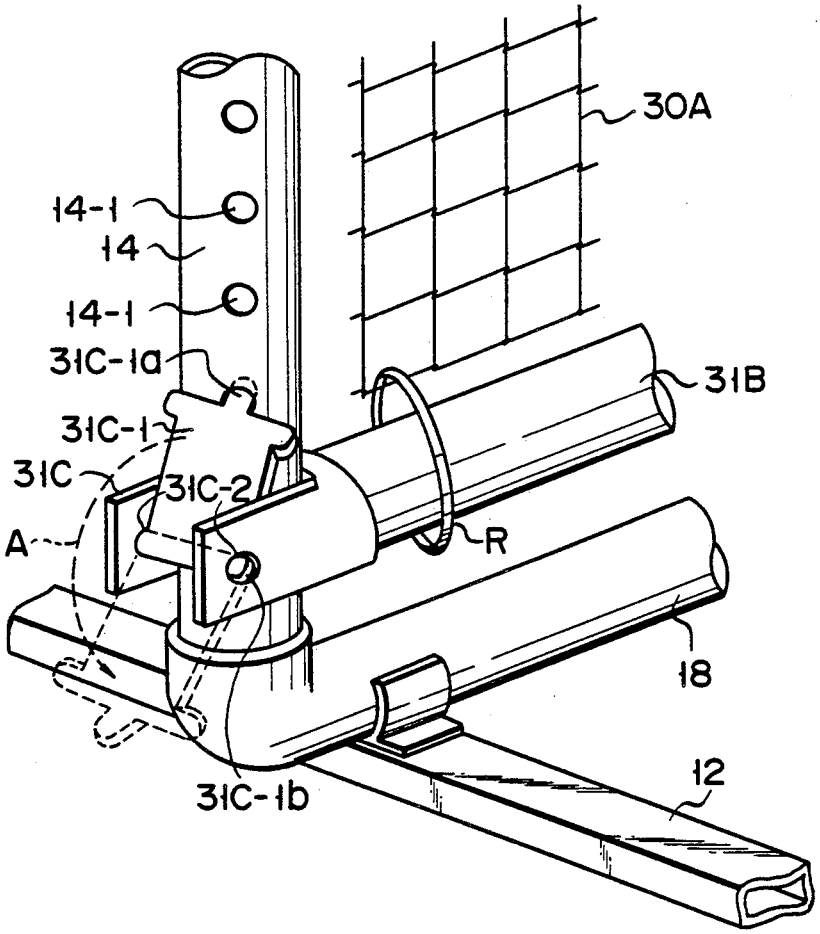

FIGS. 16 and 17 show a modification of the embodiment shown in FIG. 10. In the embodiment of FIG. 10, fork- or U-shaped end members 31B-1 and 31B-2 are fixed at both ends of adjusting horizontal frame 31B. U-shaped end members 31B-1 and 31B-2 are stopped at stopping holes 14-1 by means of stopping rods 82A and 82B, when adjusting horizontal frame 31B is pushed down to stretch net 30A. In the modification of FIGS. 16 and 17, U-shaped end member 31C is provided to have two holes 31C-2 at both side walls of member 31C. In these holes 31C-2 are inserted two legs 31C-1b formed on a stopping member 31C-1 so that stopping member 31C-1 may be freely rotated about two holes 31C-2. Stopping member 31C-1 is further provided with a stopping projection 31C-1a at the top portion thereof. This stopping projection 31C-1a may be inserted into holes 14-1 formed on vertical frame 14, when stopping member 31C-1 is set at a position as shown in FIGS. 16 and 17.

When horizontal frame 31B is pushed down slowly from the position shown in the figure, stopping projection 31C-1a is moved away from hole 14-1 and set into the next hole 14-1 formed under the hole 14-1 shown in the figure. Since the member 31C-1 is enforced to rotate in the clockwise direction by the gravity, there is no need to provide a spring to enforce the member 31C-1 in the clockwise direction.

When horizontal frame 31B is pushed down rapidly, the curved portion C formed at the stopping projection 31C-1a moves along an edge of hole 14-1, and stopping member 31C-1 is enforced to rotate in the counterclockwise direction, as shown by an arrow A, so that the engagement between the stopping projection 31C-1a and hole 14-1 is disconnected. Thus, the tension adjustment of net 31A in the modification of FIGS. 16 and 17 can be performed more easily when compared with that of the embodiment of FIG. 10.

Figure 18:
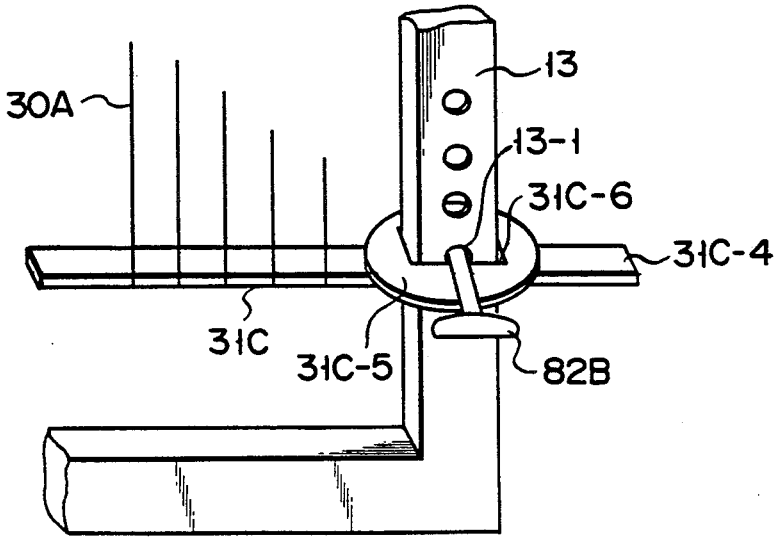
FIG. 18 shows a further modification of the embodiment shown in FIG. 10.

FIG. 18 shows a further modification of the embodiment shown in FIG. 10. In the modification of FIG. 18, the end portion 31C-5 is provided between the frame 31C and the handle 31C-4. The end portion 31C-5 has a rectangular hole 31C-6 in which the side frame 13 is inserted. The modification as shown in FIG. 18 also can be used to adjust the tension of net 30A easily.

The ball game apparatus according to the present invention can be installed in commercial use for various ball games in electronic game halls, training gyms, and trial trailing at tennis racket sales counters in addition to individual use.

According to the present invention as has been described above, there is provided a ball game apparatus wherein trailing for tennis and other ball games can be efficiently enjoyed with factors of an electronic game and a sufficient effect can be obtained in a very small space such as a garage. In particular, no obstacle is present in front of net 30. Even if the ball does not hit net 30, the ball can return to a position near the user because the ball is tied to the elastic cord. Therefore, even a handicapped person in a wheelchair can perform sufficient training.

What is claimed is:

1. A ball game apparatus comprising support means having a net suspending horizontal frame, a net which includes strings directed in the vertical direction and an upper end of the net is fixed to said horizontal frame, a movable frame mounted to a lower end of said net, guide means, mounted on said support means, for vertically movably supporting both ends of said movable frame, a net fixing frame arranged below said net, a bolt one end of which is threadably engaged at substantially the center of said movable frame and the other end of which is pivotally engaged with said net fixing frame, a rotary handle fixed to said bolt, elastic cord means one end of which is locked on said support means, a ball coupled to the other end of said elastic cord means, and target means, mounted on said support means at a position behind said net and having a sensing range in a predetermined zone in front of said net, for outputting a hit signal when said ball flying toward said net falls within the sensing range and a corresponding ball speed signal representing a ball speed, said target means being provided with a display unit for displaying the number of hits, and individual ball speeds, and total points as a product of the number of hits and an average value of the ball speeds.

2. A ball game apparatus comprising:

support means including a net suspending horizontal frame;

a net constituted with strings and having an upper end fixed to the horizontal frame;

a movable frame mounted to a lower end of said net;

engaging means provided on both sides of said movable frame for vertically movably guiding said movable frame along the vertical direction of said net;

a net fixing frame arranged below said net;

means for pulling said movable frame toward said net fixing frame;

means for adjusting a pulling force of said pulling means;

elastic cord means one end of which is locked on said support means;

a ball coupled to the other end of said elastic cord means; and target means mounted on said support means at a position behind said net and having a sensing range in a predetermined zone in front of said net for detecting a ball speed;

said engaging means including U-shaped members provided at both ends of said movable frame engaging with said support means.

3. The apparatus according to claim 2, wherein said net has a hexagonal mesh pattern having six sides.

4. The apparatus according to claim 2, wherein said engaging means includes two end portions provided at both end portions of said movable frames and has a U-shaped portion having a pair of supporting holes for rotatably supporting a stopping member for stopping said movable frames at a desired position on said vertical frames so as to obtain a desired tension of the net.

5. The apparatus according to claim 2, wherein said engaging means includes two end portions provided at both end portions of said movable frames, each of said end portions having an opening in which support means is inserted and an extension member extended at the end portion of the movable frames.

6. The apparatus according to claim 5, wherein said supporting means includes two vertical frames provided at both sides of said net, and said engaging means includes a plurality of holes provided on said vertical frames, and stopping rods for stopping said end portions at a desired hole position on said vertical frames.

7. A ball game apparatus comprising:

support means including a net suspending horizontal frame;

a net constituted with strings and having an upper end fixed to the horizontal frame;

a movable frame mounted to a lower end of said net;

engaging means provided on both sides of said movable frame for vertically movably guiding said movable frame along the vertical direction of said net;

a net fixing frame arranged below said net;

means for pulling said movable frame toward said net fixing frame;

means for adjusting a pulling force of said pulling means;

elastic cord means one end of which is locked on said support means;

a ball coupled to the other end of said elastic cord means; and target means mounted on said support means at a position behind said net and having a sensing range in a predetermined zone in front of said net for detecting a ball speed;

said pulling means including a bolt having one end threadably engaged at substantially the center of said movable frame and the other end of which is pivotally engaged with said net fixing frame, and a rotary handle fixed to said bolt to adjust the tension of said net.

8. The apparatus according to claim 7, wherein said net has strings directed in the vertical direction thereof.

9. The apparatus according to claim 7, wherein said net has a hexagonal mesh pattern having six sides.

10. The apparatus according to claim 7, wherein said engaging means includes U-shaped end members provided at both ends of said movable frame engaging with said support means.

11. A ball game apparatus comprising:

support means including a net suspending horizontal frame;

a net constituted with strings and having an upper end fixed to the horizontal frame;

a movable frame mounted to a lower end of said net;

engaging means provided on both sides of said movable frame for vertically movably guiding said movable frame along the vertical direction of said net;

a net fixing frame arranged below said net;

means for pulling said movable frame toward said net fixing frame;

means for adjusting a pulling force of said pulling means;

elastic cord means one end of which is locked on said support means;

a ball coupled to the other end of said elastic cord means; and target means mounted on said support means at a position behind said net and having a sensing range in a predetermined zone in front of said net for detecting a ball speed;

said pulling means including a bolt having one end fixed at substantially the center of said movable frame and the other end passed through a hole formed at a corresponding portion of said net fixing frame, and a rotary handle threadably engaged with the bolt for adjusting the tension of said net.

12. The apparatus according to claim 11, wherein said net has strings directed in the vertical direction thereof.

13. The apparatus according to claim 11, wherein said net has a hexagonal mesh pattern having six sides.

14. The apparatus according to claim 11, wherein said engaging means includes U-shaped end members provided at both ends of said movable frame engaging with said support means.

15. A ball game apparatus comprising:

support means including a net suspending horizontal frame;

a net constituted with strings and having an upper end fixed to the horizontal frame;

a movable frame mounted to a lower end of said net;

engaging means provided on both sides of said movable frame for vertically movably guiding said movable frame along the vertical direction of said net;

a net fixing frame arranged below said net;

means for pulling said movable frame toward said net fixing frame;

means for adjusting a pulling force of said pulling means;

elastic cord means one end of which is locked on said support means;

a ball coupled to the other end of said elastic cord means; and target means mounted on said support means at a position behind said net and having a sensing range in a predetermined zone in front of said net for detecting a ball speed;

said engaging means including guide means provided on said support means for vertically movably guiding both ends of said movable frame.

16. The apparatus according to claim 15, wherein said net has strings directed in the vertical direction thereof.

17. The apparatus according to claim 15, wherein said net has a hexagonal mesh pattern having six sides.

18. The apparatus according to claim 15, wherein said engaging means includes U-shaped end members provided at both ends of said movable frame engaging with said support means.

19. A ball game apparatus comprising:

support means including a net suspending horizontal frame;

a net constituted with strings and having an upper end fixed to the horizontal frame;

a movable frame mounted to a lower end of said net;

engaging means provided on both sides of said movable frame for vertically movably guiding said movable frame along the vertical direction of said net;

a net fixing frame arranged below said net;

means for pulling said movable frame toward said net fixing frame;

means for adjusting a pulling force of said pulling means;

elastic cord means one end of which is locked on said support means;

a ball coupled to the other end of said elastic cord means; and target means mounted on said support means at a position behind said net and having a sensing range in a predetermined zone in front of said net for detecting a ball speed;

said target means including control means for outputting a hit signal when said ball flying toward said net falls within the sensing range, means for outputting a corresponding ball speed signal representing a ball speed flying in the sensing range, means for displaying a number of hits, individual ball speed, and total points as a product of the number of hits and an average value of the ball speed.

20. The apparatus according to claim 19, wherein said net has strings directed in the vertical direction thereof.

21. The apparatus according to claim 19, wherein said net has a hexagonal mesh pattern having six sides.

22. The apparatus according to claim 19, wherein said engaging means includes U-shaped end members provided at both ends of said movable frame engaging with said support means.

* * * * *